US006045404A

United States Patent [19]

Myer

[11] Patent Number: 6,045,404

[45] Date of Patent: Apr. 4, 2000

[54] ELECTRICAL CONNECTOR HAVING A TERMINAL POSITION ASSURANCE DEVICE

[75] Inventor: John Mark Myer, Millersville, Pa.

[73] Assignee: The Whitaker Corporation, Wilmington, Del.

[21] Appl. No.: 09/095,634

[22] Filed: Jun. 11, 1998

Related U.S. Application Data

[60] Provisional application No. 60/051,352, Jun. 30, 1997.

[51] Int. Cl.[7] ..... H01R 13/40

[52] U.S. Cl. ..... 439/595

[58] Field of Search ..... 439/595, 594

[56] References Cited

U.S. PATENT DOCUMENTS

| | | | |
|---|---|---|---|
| 4,891,021 | 1/1990 | Hayes et al. . | |
| 4,973,268 | 11/1990 | Smith et al. . | |
| 5,071,369 | 12/1991 | Denlinger et al. | 439/595 |
| 5,127,854 | 7/1992 | Fujitani et al. | 439/595 |
| 5,281,168 | 1/1994 | Krehbiel et al. | 439/595 |
| 5,522,740 | 6/1996 | Plocek et al. | 439/752 |
| 5,575,683 | 11/1996 | Saito et al. | 439/595 |
| 5,575,692 | 11/1996 | Cecil, Jr. et al. | 439/752 |
| 5,738,543 | 4/1998 | Rollins et al. | 439/595 |

*Primary Examiner*—Neil Abrams
*Assistant Examiner*—Michael C. Zarroli
*Attorney, Agent, or Firm*—Robert W. Pitts

[57] ABSTRACT

The invention is directed to an electrical connector having a housing body with a contact receiving passage therein. The contact receiving passage has a contact retention arm for securing a contact within the passage. The contact retention arm forms the outer wall of the body. A terminal position assurance member has an outer wall with an inner shoulder and a locking surface. The outer wall is received around the contact retention arm. The terminal position assurance member has a first position in which the terminal position assurance member forms a space behind the contact retention arm. The terminal position assurance member has a second position wherein the locking surface is received behind the contact retention arm thereby preventing deflection of the contact retention arm.

16 Claims, 2 Drawing Sheets

ELECTRICAL CONNECTOR HAVING A TERMINAL POSITION ASSURANCE DEVICE

CROSS REFERENCE TO RELATED APPLICATIONS

Applicant claims the benefit of previously filed Provisional Patent Application Ser. No. 60/051,352 filed Jun. 30, 1997.

FIELD OF THE INVENTION

The present invention is directed to an electrical connector having a terminal position assurance device.

BACKGROUND OF THE INVENTION

It is known to provide a terminal position assurance device for electrical connectors. One form of terminal position assurance device is used in an electrical connector having deflectable latching arms. When the contacts are inserted into such a connector, the latching arms deflect to allow passage of the contacts. When the contacts are fully inserted, the latching arms resile into their initial position and latch behind a shoulder or some other surface on the contact thereby securing the contact within the connector. A terminal position assurance device is then inserted into the connector. The terminal position assurance device has surfaces that are received into a space proximate to the latching arms. When the terminal position assurance device is in place, the surfaces prevent the latching arms from deflecting and thereby secure the contacts within the connector. A further feature of the terminal position assurance device is that the terminal position assurance device cannot be inserted into the connector unless all of the latching arms are in their normal, non-deflected position. Therefore, if one of the contacts is not properly positioned, the latching arm will be deflected and the terminal position assurance device will be prevented from being inserted into the connector.

A typical electrical connector having latching arms for securing the contacts within the passages has an outer wall surrounding the periphery of the electrical connector, on the outer side of the latching arms. Furthermore, the terminal position assurance device typically has two walls, one wall is a locking arm which is pushed into the electrical connector and received into the space to prevent the latching arm from deflecting and the second wall which is received on the outer side of the electrical connector wall to secure the terminal position assurance member onto the electrical connector. As the demand is for electrical connectors to become smaller and smaller, it is necessary to eliminate some of the plastic within the electrical connector in order to make the housing smaller.

What is needed is an electrical connector having a smaller dimension than the typical electrical connector.

SUMMARY OF THE INVENTION

The invention is directed to an electrical connector having a housing body with a contact receiving passage therein. The contact receiving passage has a contact retention arm for securing a contact within the passage. The contact retention arm forms the outer wall of the body. A terminal position assurance member has an outer wall with an inner shoulder and a locking surface. The outer wall is received around the contact retention arm. The terminal position assurance member has a first position in which the terminal position assurance member forms a space behind the contact retention arm. The terminal position assurance member has a second position wherein the locking surface is received behind the contact retention arm thereby preventing deflection of the contact retention arm.

The invention is further directed to an electrical connector having a body with contact receiving passages therein. The contact receiving passage has a contact retention arm for securing a contact within the passage. The contact retention arm forms the outer wall of the body. A terminal position assurance member has a wall to be received on the outer side of the contact retention arm. The terminal position assurance member having a shoulder and a locking surface. The shoulder and the locking surface are formed on the inner side of the wall. The terminal position assurance member has a first position in which the terminal position assurance member forms a space behind the retention arm to allow deflection of the retention arm for insertion of the contact within the passage. The terminal position assurance member has a second position in which the locking surface is behind the retention arm thereby preventing the deflection of the retention arm and to secure the contact within the passage. When the contact is not properly seated within the passage and the retention arm is deflected, if the terminal position assurance member is moved from the first position to the second position, the shoulder will stub on the retention arm thereby indicating that the contact is improperly inserted within the passage.

BRIEF DESCRIPTION OF THE DRAWINGS

An embodiment of the present invention will now be described with reference to the accompanying drawings, in which.

DETAILED DESCRIPTION OF AN EMBODIMENT OF THE INVENTION

Figure 1:
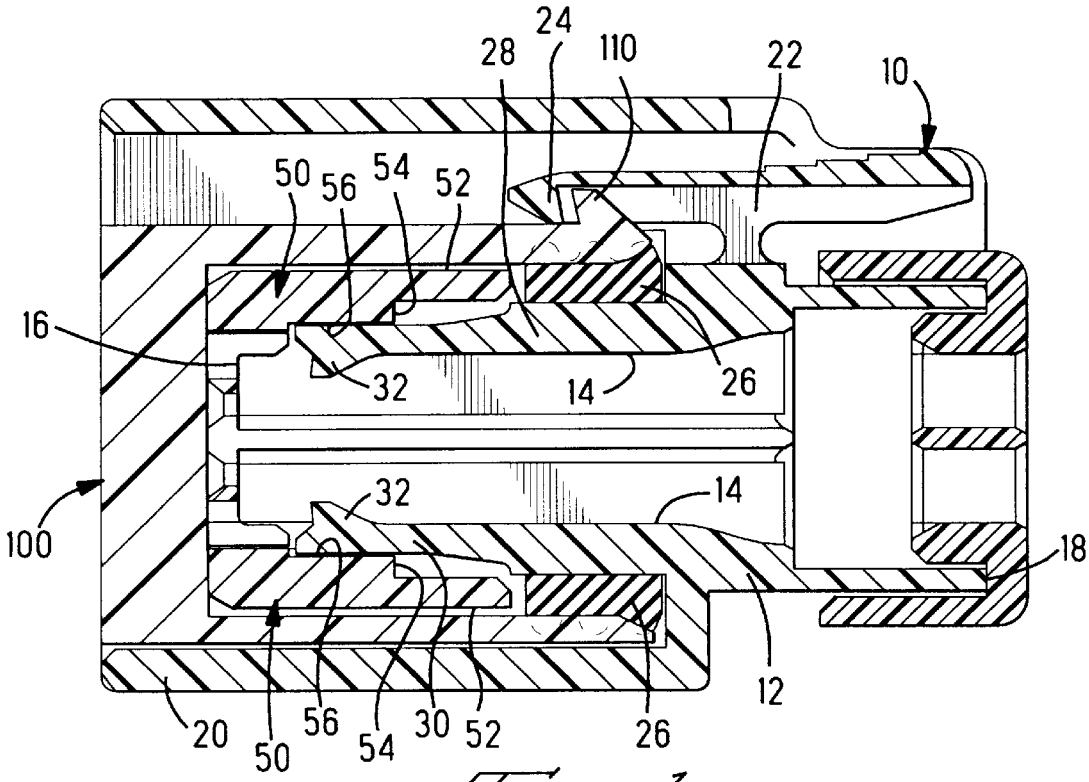
FIG. 1 is a cross sectional view of an electrical connector with a terminal position assurance device in a locking position.

FIG. 1 shows a cross sectional view of an electrical connector 10 mating with a mating connector 100. The mating connector is represented at 100 however no details are shown of a mating connector. The mating connector 100 will have many other features, such as contact receiving passages and contacts, which are not shown in FIG. 1. The electrical connector has a housing 12 with contact receiving passages 14 therein for receiving contacts, not shown. The electrical connector 10 has a mating end 16 and rearward end 18. The electrical connector 10 further has a shroud 20 which extends around the mating end 16 of the electrical connector 10 and also surrounds an inner body 28 of the electrical connector 10.

Electrical connector 10 has a housing latch 22 having a latching protrusion 24 thereon. The housing latch 22 is used to latch and secure the mating connector 100 therewith. The mating connector 100 has a complimentary latching protrusion 110 which engages with the latching protrusion 24 to secure the mating connector 100 with the electrical connector 10.

Electrical connector 10 has seal 26 which extends around the inner body 28 of the electrical connector 10 within the shroud 20. When the mating connector 100 is connected with the electrical connector 10 a portion of the mating connector 100 will engage the outer surfaces of seal 26 thereby providing a sealing interface between the electrical connector 10 and the mating connector 100.

When the mating connector 100 is mated with the electrical connector 10, the mating connector is received within the shroud 20, and surrounds the inner body 28, and engages the seal 26 thereby providing the sealing interface. The mating connector 100 will have a series of electrical contacts secured therein to mate with the electrical contacts which are in the contact receiving passages 14, neither of these contacts being shown in FIG. 1.

Within the contact receiving passages 14 there are contact retention arms 30. The retention arms 30 each have a latching protrusion 32 which is used to engage a shoulder on the electrical contact to secure the contact therein.

In a typical electrical connector with a terminal position assurance device, there would be a space behind the latching arm, that is the side opposite to the latching protrusion 32, and an outer peripheral wall received around the outer side of the contact retention arms 30. However, in the present invention, the contact retention arms 30 provide the outer wall of the electrical connector 10 and more specifically the outer wall of the inner body 28.

A terminal position assurance member (TPA) 50 is inserted from the front end or the mating end 16 of the electrical connector 10 to provide a backup to the retention arms 30 to lock the contacts within the electrical connector 10 and also to alert the operator when a contact is improperly mounted within the electrical connector 10. The TPA 50 has an outer wall 52, a shoulder 54 and a locking surface 56 disposed therealong. When the TPA 50 is fully inserted onto the electrical connector 10, as is shown in FIG. 1, the locking surface 56 will be received behind the contact retention arm 30 thereby preventing the deflection of the contact retention arm 32. In this state, the TPA is acting as a backup for the contact retention arm 30 in that it prevents the contact retention arm 30 from deflecting and thereby keeps the contact secured within the passage 14.

Figure 2:
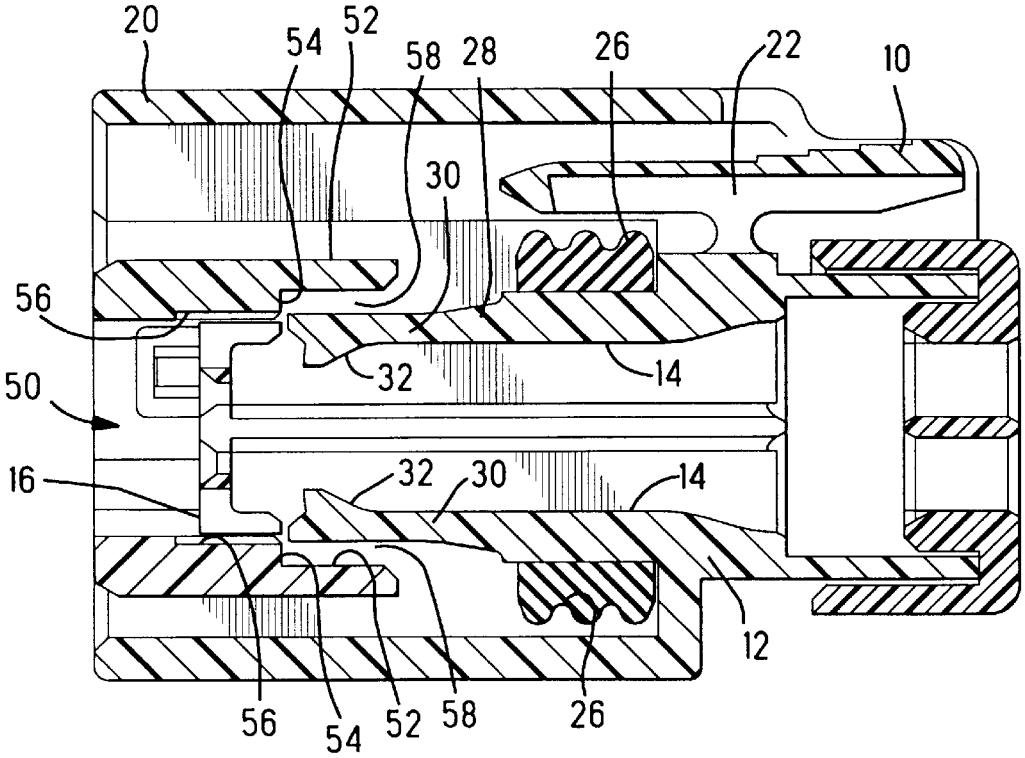
FIG. 2 is a cross section of an electrical connector showing the terminal position device in a pre-locking position.

FIG. 2 shows the electrical connector 10 and the TPA 50. The TPA 50 is shown in the prelatch position, that is the position which it is in prior to and during the insertion of the contacts into the contact receiving passageway 14. In this position, the locking surface 56 is received forwardly from the contact retention arms 30, the shoulder 54 also received forwardly of the retention arms 30. This forms a space 58 behind the contact retention arm 30 which allows the contact retention arm 30 to be deflected into the space 58. When the TPA 50 is in this position, the contacts can be inserted into the electrical connector 10 from the rear 18 of the electrical connector 10. During insertion of the contact, the contact retention arm 30 will deflect into the space 58. When the contact is properly seated within the contact passageway 14, the contact retention arm 30 will resile to its normal position and the latching protrusion 32 will latch behind a shoulder or some other space on the electrical contact, thereby securing the contact within the electrical connector 10. When the TPA 50 is in the prelatch position, as shown in FIG. 2, it will also act as an overstress for the retention arm 30. The outer wall 52 will prevent the contact retention arm 30 from being deflected to the point where it might break. The outer wall 52 will serve this overstress function during insertion of the contacts and also if it is necessary for the contacts to be removed from the electrical connector 10 to either replace or repair the contacts. In order to remove the contacts, it is necessary for the operator to first move the TPA 50 to the prelatch position, then to deflect the retention arm 30 to remove the contact, and therefore, the outer wall 52 will serve to protect the retention arm 30 from overstress during this process.

If all of the contacts are properly inserted into the electrical connector 10, the TPA 50 can be moved from its prelatched position, as is shown in FIG. 2, to its final position as is shown in FIG. 1, because all of the contact retention arms 30 will be in their normal position. Therefore, the TPA 50 will provide a backup for all of the contact retention arms 30 thereby securing the contacts within the electrical connector 10.

Figure 3:
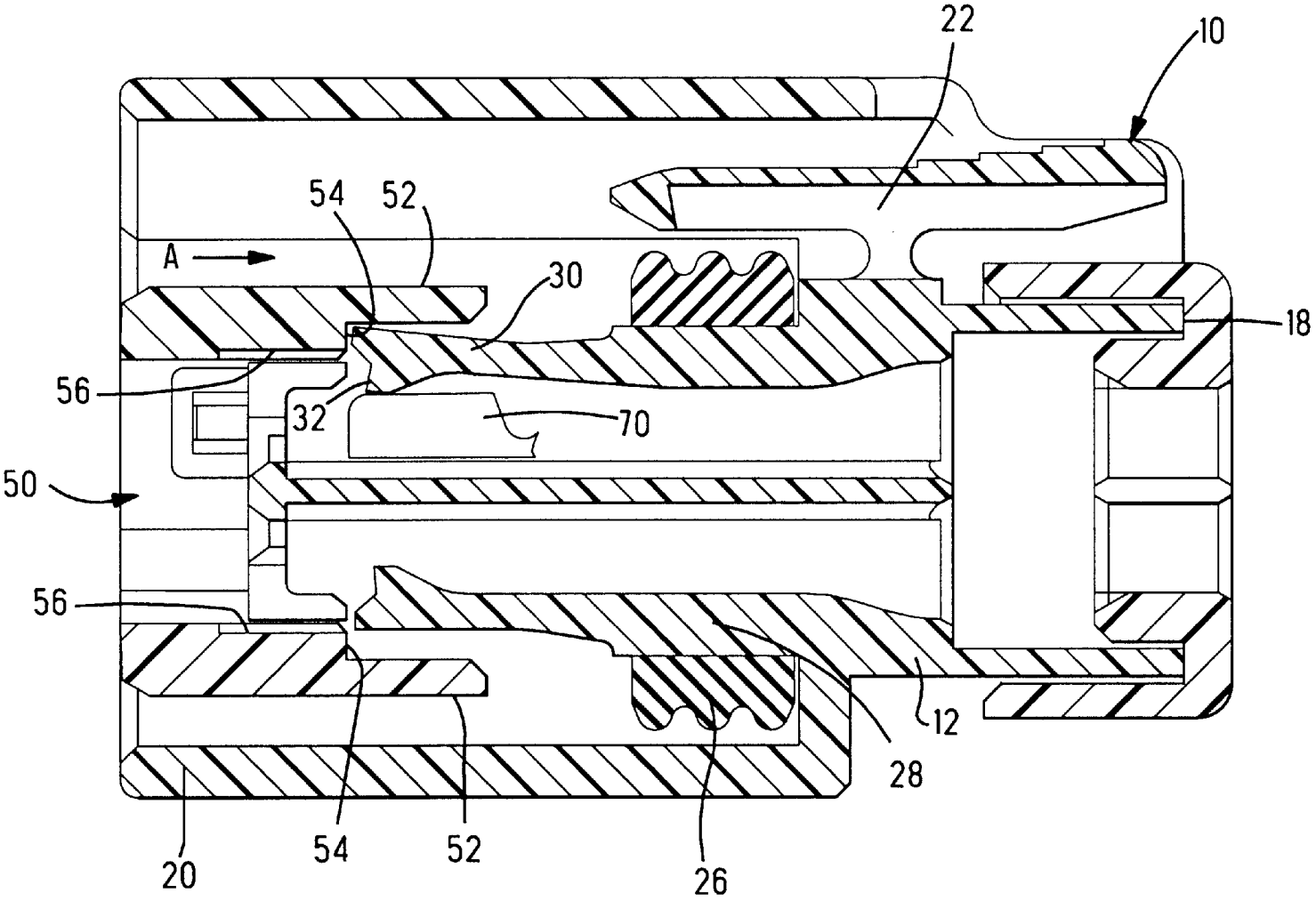
FIG. 3 is a cross sectional view of the electrical connector having an improperly mounted electrical contact within the electrical connector.

FIG. 3 shows the electrical connector 10 having a electrical contact 70 improperly inserted within the electrical connector 10. In this position, it can be seen that the contact retention arm 30 is still deflected from its normal position. That is in FIG. 2, the contact retention arm would be pushed up into space 58. When an attempt is made to move the TPA from the prelatch position as shown in FIG. 2, into the final position as is shown in FIG. 1, the shoulder 54 will stub on the front end of the contact retention arm 30 thereby preventing the TPA 50 from being moved completely to a final position. This will alert the operator that one or more of the contacts 50 are improperly positioned and that their position must be corrected before the TPA 50 can be moved to its final position so that the TPA 50 can act as a back up to the contact retention arms 30 to prevent them from deflecting and allowing the contact 30 from being removed from the electrical connector 10.

In the present invention, the outer wall of the TPA and the outer wall of the inner body 28 of the electrical connector have been eliminated thereby having the contact retention arms 30 as the outer portion of the inner body 28 of the electrical connector. Furthermore the TPA 50 only comprises one wall. In the electrical connector of the present invention the overall size of the connector is reduced because the two outer walls have been eliminated on the electrical connector and the TPA thereby reducing the overall size of the electrical connector.

The electrical connector of the present invention and many of its attendant advantages will be understood from the foregoing description. It is apparent that various changes may be made in the form, construction, and arrangement of parts thereof without departing from the spirit or scope of the invention or sacrificing all of its material advantages.

What is claimed is:

1. An electrical connector comprising:

a housing body having an outer wall which defines a passageway for receiving a contact, the outer wall having a deflectable contact retention member for retaining the contact within the passageway; and a terminal position assurance member having a locking surface and a prelatch surface, the terminal position assurance member being movable between a prelatch position and a latch position, whereby when the terminal position assurance member is in the prelatch position the prelatch surface is positioned adjacent the contact retention member but distanced from the contact retention member by a recess to accommodate deflection of the contact retention member and insertion of the contact into the passageway, and when in the latch position the locking surface is adjacent to and in contact with the contact retention member, thereby preventing deflection of the contact retention member and removal of the contact from the passageway.

2. The electrical connector of claim 1, wherein the locking surface and the prelatch surface define a shoulder therebetween, such that the shoulder stubs on the contact retention member when the contact retention member is deflected into the recess, thereby precluding the terminal position assurance member from moving from the prelatch position to the latch position.

3. The electrical connector of claim 1, wherein the prelatch surface is adjacent the locking surface, the prelatch surface being offset from the locking surface.

4. The electrical connector of claim 1, wherein the contact retention member has a protrusion extending into the contact receiving passageway for engaging the contacts, such that when the contact is improperly received within the contact receiving passageway, the projection is engaged by the contact thereby deflecting the contact retention member into the recess, and when the contact is properly received in the contact receiving passageway, the projection engages and retains the contact within the contact receiving passageway.

5. The electrical connector of claim 1, wherein the housing body has a shroud extending coaxially to the outer wall of the housing body.

6. The electrical connector of claim 5, wherein the shroud is integrally formed with the housing body.

7. The electrical connector of claim 5, wherein the shroud has a latching protrusion extending inwardly toward the housing body for engaging a complementary projection of a mating connector such that when the electrical connector is mated with a complementary connector, the latching protrusion engages the complementary projection to retain the connectors in mating engagement.

8. The electrical connector of claim 1, wherein the housing body has a seal annularly disposed about the outer wall.

9. An electrical connector comprising:

a housing body having at least one contact receiving passageway bound by an outer wall, the outer wall having at least one contact retention member aligned with each contact receiving passageway for releasably engaging each contact; and a terminal position assurance member about the housing body movable between a prelatch position and a latch position, the terminal position assurance member having a prelatch surface and a locking surface, such that when the terminal position assurance member is in the prelatch position, the prelatch surface is located adjacent the contact retention member but distanced from the contact retention member by a recess so as to accommodate deflection thereof and insertion of the contact into the passageway, and when the terminal position assurance member is in the latch position, the locking surface is located adjacent to and in contact with the latch member thereby preventing deflection thereof and removal of the contact from the passageway.

10. The electrical connector of claim 9, wherein the locking surface and the prelatch surface define a shoulder therebetween, such that the shoulder stubs on the contact retention member when the contact retention member is deflected into the recess, thereby precluding the terminal position assurance member from moving from the prelatch position to the latch position.

11. The electrical connector of claim 9, wherein the prelatch surface is adjacent the locking surface, the prelatch surface being offset from the locking surface.

12. The electrical connector of claim 9, wherein the contact retention member has a projection extending into the contact receiving passageway for engaging the contacts, such that when the contact is improperly received within the contact receiving passageway, the projection is engaged by the contact, thereby deflecting the contact retention member into the recess, and when the contact is properly received in the contact receiving passageway, the projection engages and retains the contact within the contact receiving passageway.

13. The electrical connector of claim 9, wherein the housing body has a shroud extending coaxially to the outer wall of the housing body.

14. The electrical connector of claim 13, wherein the shroud is integrally formed with the housing body.

15. The electrical connector of claim 13, wherein the shroud has a mating projection extending inwardly toward the housing body for engaging a complementary projection of a mating connector such that when the electrical connector is mated with a complementary connector, the mating projection engages the complementary projection to retain the connectors in mating engagement.

16. The electrical connector of claim 9, wherein the housing body has a seal annularly disposed about the outer wall.

* * * * *